United States Patent [19]

Kruger et al.

[11] 4,078,496

[45] Mar. 14, 1978

[54] ANTIRUNAWAY DEVICE FOR HAND GRENADE FUZE

[75] Inventors: Harold W. Kruger, Rutherford; Ted Thuen, Fairfield, both of N.J.

[73] Assignee: The United States of America as represented by the Secretary of the Army, Washington, D.C.

[21] Appl. No.: 740,622

[22] Filed: Nov. 5, 1976

[51] Int. Cl.[2] ..... F42B 27/02; F42C 9/06

[52] U.S. Cl. ..... 102/64; 102/82

[58] Field of Search ..... 102/64, 76, 81.6, 82, 102/83

[56] References Cited

U.S. PATENT DOCUMENTS

| | | | |
|---|---|---|---|
| 2,938,463 | 5/1960 | Jasse | 102/82 X |
| 3,430,568 | 3/1969 | Amster | 102/82 |

*Primary Examiner*—Verlin R. Pendegrass
*Attorney, Agent, or Firm*—Nathan Edelberg; A. Victor Erkkila; Max Yarmovsky

[57] ABSTRACT

An antirunaway device for a hand grenade fuze utilizes a spring biased detented firing pin-slider assembly to interlock a torque biased rotatably held detonator assembly in an out-of-line "safe" position when the biased firing pin-slider assembly senses the absence of a restraining, properly functioning, axially aligned dashpot timer assembly. A slider blocking member is depressed into a groove provided therefor, by the slider assembly, to allow the detonator assembly to rotate into an in-line "armed" position when the slider assembly mechanically senses the presence of a properly functioning dashpot timer assembly, but remains in a blocking position when the timer is not properly functioning.

4 Claims, 5 Drawing Figures

ANTIRUNAWAY DEVICE FOR HAND GRENADE FUZE

GOVERNMENTAL INTEREST

The invention described herein was made in the course of a contract with the Government and may be manufactured, used and licensed by or for the Government for governmental purposes without the payment to us of any royalty thereon.

BACKGROUND OF THE INVENTION

Various means have been used in the prior art to "safe" and "arm" a grenade. Prior art grenade fuze devices frequently utilized a so-called "mouse-trap" feature in order to initiate an impact type detonator. The problem with some of these prior art grenade fuzes devices was that the detented spring biased striker and primer system could become unreliable primarily because they were subject to environment deterioration. Frequently prior art devices were found to be unsafe to use because of premature malfunction due to the inadvertent omission of a delay train or a critical portion of the safing mechanism. In order to overcome the inadvertent omission of a delay train element from a grenade fuze and in order to insure that it would not malfunction, prior art devices were usually subject to costly X-ray and visual inspections. The problem with X-ray inspection of prior art fuzes having dashpot timers was that it was very difficult to differentiate the missing, less dense materials, such as a fluid from the dense metal structural elements of the fuze.

SUMMARY OF THE INVENTION

The present invention relates to an antirunaway detonating fuze for hand grenades which require a fixed time delay after release of a safety lever. The present invention utilizes a sealed firing mechanism that is resistant to environmental influence.

An object of the present invention is to provide an antirunaway grenade fuze which will insure keeping the fuze in a "safe" unarmed condition in the event that a dashpot delay timer unit is inadvertently left out of the fuze assembly.

Another object of the present invention is to provide an antirunaway member to a grenade fuze which will insure keeping the fuze in a "safe" unarmed condition in the event that a defective dashpot timer is assembled therein.

Another object of the present invention is to provide a sealed firing and delay mechanism to an antirunaway grenade fuze.

Another object of the present invention is to provide an antirunaway hand grenade fuze which utilizes a detented firing pin-slider assembly to hold a detonator assembly in an out-of-line "safe" position.

A further object of the present invention is to provide a safety device for a hand grenade fuze that mechanically senses the absence of the viscous fluid of a dashpot delay timer by interjecting a blocking member that prevents subsequent arming of the grenade.

For a better understanding of the present invention, together with other and further objects thereof, reference is made to the following descriptions taken in connection with the accompanying drawings.

BRIEF DESCRIPTION OF THE DRAWINGS

Throughout the following description like reference numerals are used to denote like parts of the drawings.

DESCRIPTION OF THE PREFERRED EMBODIMENTS

Figure 1:
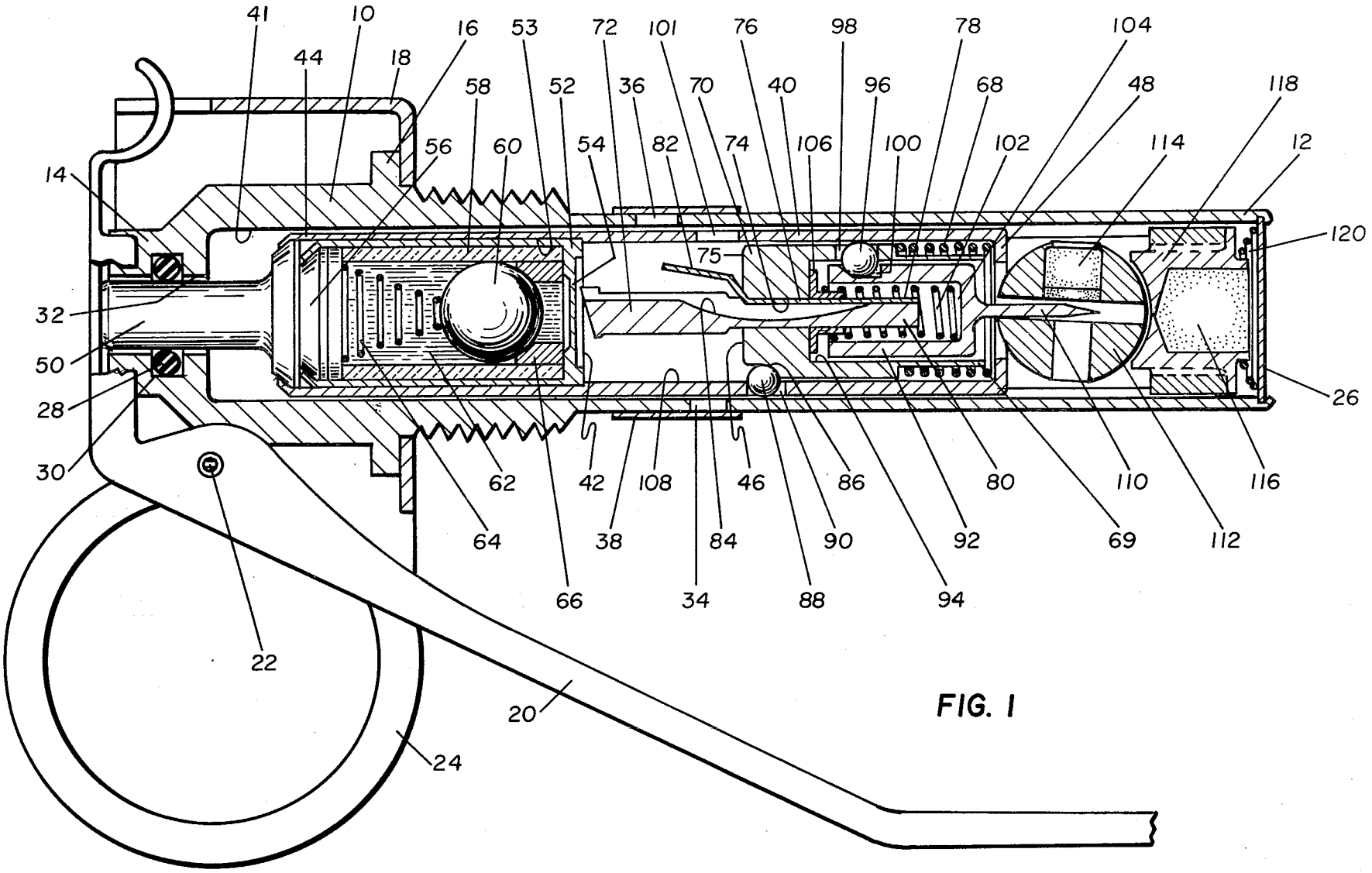
FIG. 1 is a partial diametral, longitudinal cross-section view of the antirunaway hand grenade fuze shown prior to pulling of the safety pin.

Referring to FIG. 1 the fuze has a hollow tubular body housing member 10 which comprises a rear end 12 and a forward end 14. The body member 10 has a shoulder 16 peripherally disposed thereon to which a bracket member 18 is fixedly attached. A safety lever 20 is pivoted on bracket 18 and restrained thereon by safety pin 22 which is in turn attached to safety pin pull ring 24. The housing 10 is sealed at the rear end 12 by a staked closure disc 26 and at the forward end by "O" ring 28 located in "O" ring groove 30 which is located in the forward end 14 in an axial bore 32. Housing 10 has an arming hole 34 transversely positioned therein and a body housing firing pin detent ball hole 36 transversely positioned slightly diametrically forward of arming hole 34. A foil sleeve 38 for covering holes 34 and 36 is sealed to housing 10. A tubularly shaped timer housing 40 is slidably disposed in the axially aligned longitudinal cavity 41 of body housing 10 and has a dashpot timer assembly 42 fixedly located in timer housing forward end 44 and a detented biased firing-pin-slider assembly 46 slidably positioned in timer housing partially open rear end 48. The forward end 44 of timer housing 40 is staked to housing cap 50 which is slidably positioned in "O" ring 28 and body axial bore 32. The dashpot timer assembly 42 comprises a cup shaped dashpot housing member 52 positioned in timer housing counterbore 53 having a sealing disc 54 on one end and a staked dashpot cap member 56 on the other end. Fixedly located within cup shaped member 52 is a tubular piston sleeve 58. A ball piston 60 is biasedly slidably held in the rear end of sleeve 58, in a viscous dashpot fluid 62, by helical conically shaped dashpot spring 64 against tubular dashpot stop 66. The firing pin-slider assembly 46 is biasedly disposed in timer housing 40 by timing spring 68 which is located intermediate timer housing partially open rear end 48 and the front open end 69 of cup shaped detented slider member 70. Slider member 70 has a grooved timing pin 72 slidably and axially aligned in a timing pin axial slider member bore 74 located in rear end 75. A step shaped cantilevered antirunaway spring 76 has a fixed end 78 attached to the rear end 80 of timing pin 72.

The free end 82 of the antirunaway spring 76 is operatively positioned over, and is capable of fitting into a timing pin groove 84. When the fuze shown in FIG. 1 is in its "safe" position, detent slider member 70 is releasably held at a detent retaining groove 86 by arming ball 88 which is operatively disposed in a timer housing detent arming hole 90. A cup shaped firing pin 92 is releasably and biasedly held in a slider member axial bore 94 by a firing pin detent ball 96. Detent ball 96 is partially disposed in slider member firing pin detent hole 98 and partially in a firing pin caming groove 100. Under the "safe" position, the timer housing firing pin detent ball hole 101 is not in line with either the body housing firing pin detent ball hole 36 or detent ball 96. Firing pin spring 102 is biasedly disposed intermediate the shaped firing pin cavity 104 and a slider eyelet member 106 which is in turn fixedly attached to slider member 70 and axially aligned with slider member bore 74. The firing pin-slider assembly 46 when released by arming ball 88 is free to biasedly slidably move along the interior wall 108 of the timing housing 40 to a point at which the firing pin impact point 110 is withdrawn from the tortionally biased detonator rotor disc member 112. Rotor disc 112 contains a detonator 114 positioned 90° out-of-line with respect to a booster charge 116 which is located in spring biased booster cup 118 member. Booster cup 118 is forcibly urged by arming spring 120 against the timer housing rear end 48.

Figure 2:
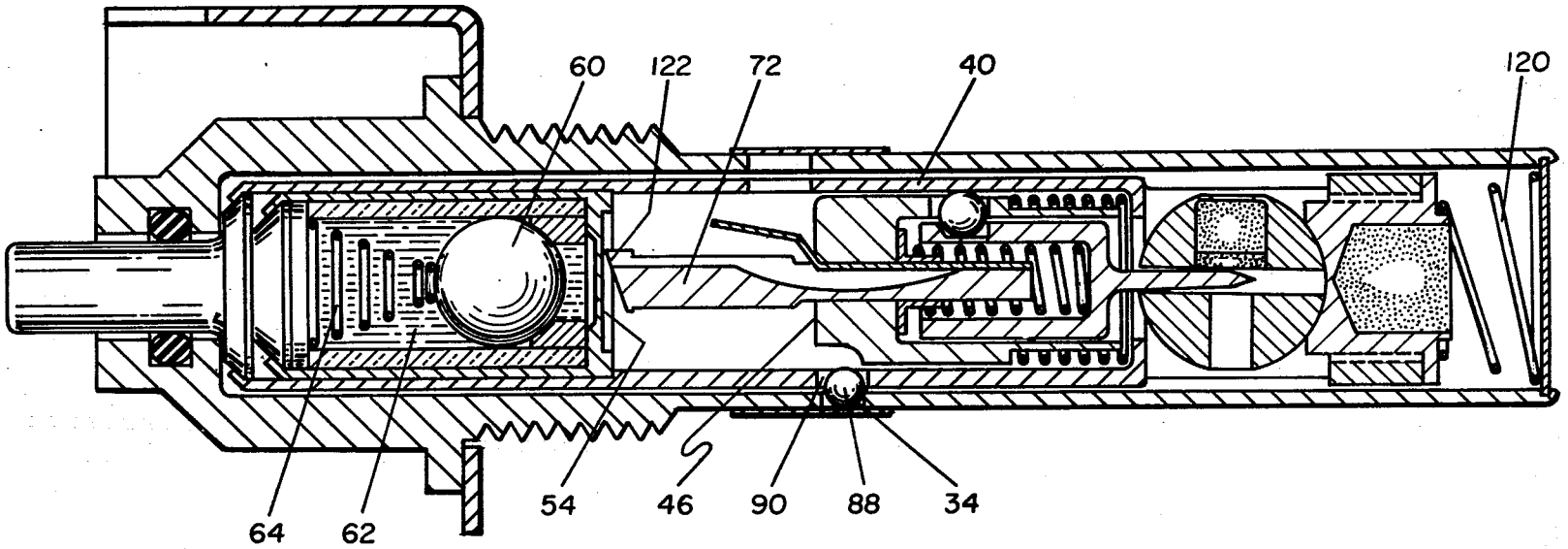
FIG. 2 is a partial cross-sectional view of the grenade fuze shown in FIG. 1 just after the hand grenade fuze safety pin has been pulled.

Referring now to FIGS. 1 and 2, in operation, when safety pin 22 is removed the safety lever 20 is ejected from bracket 18. Safety lever 20 under these conditions no longer acts as a restraint against the longitudinal movement of timer housing 40 toward the body housing forward end 14 caused biasing force by the arming spring 120. The forward movement of timer housing 40 causes the timer housing detent arming hole 90 to line up with the body housing hole 34 and permits arming ball 88 to move into hole 34 from its detenting position shown in FIG. 1 to an arming position. In the "armed" position shown in FIG. 2 the release of the firing pin-slider assembly 46 allows the leading edge 122 of the timing pin 72 to cut the sealing disc 54 and to contact piston ball 60.

Figure 3:
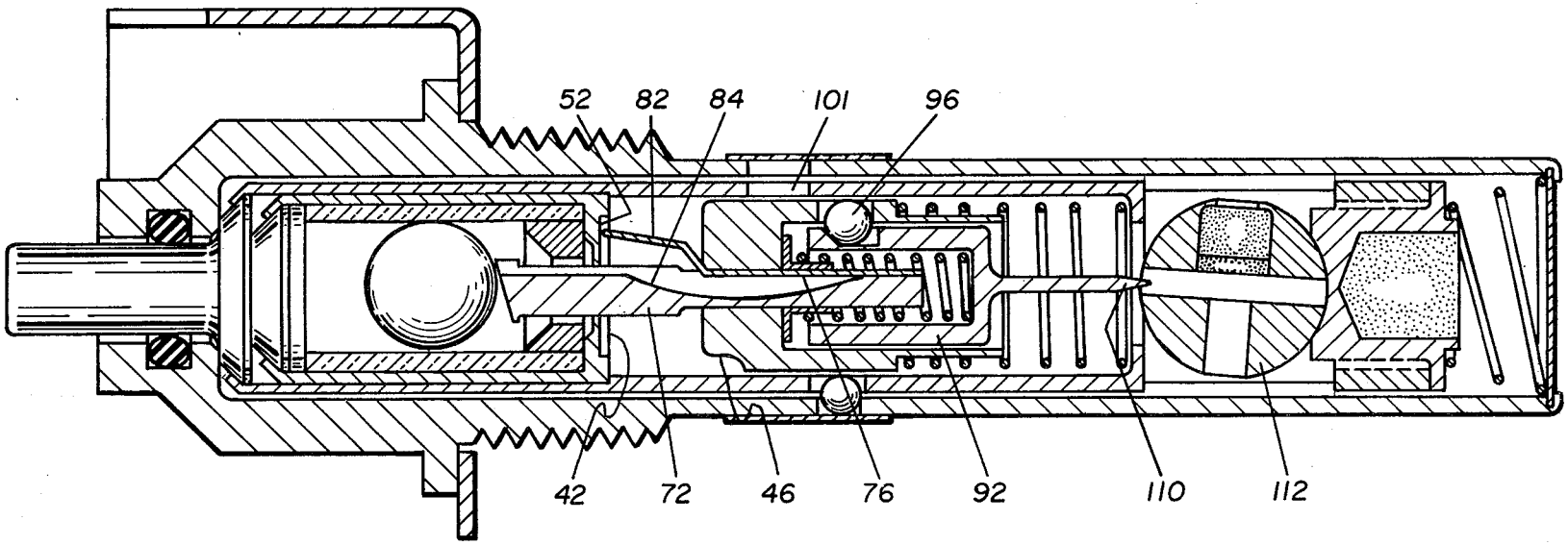
FIG. 3 is a partial cross-sectional view of the fuze shown in FIG. 2 showing how a blocking member keeps a firing pin-detent biased slider assembly and a rotary tortionally biased detonator assembly in a "safe" unarmed position, after mechanically sensing missing dashpot fluid and a missing dashpot spring.

Referring now to FIG. 3, the viscous fluid 62 and dashpot spring 64 of the dashpot timer assembly 42, of the fuze shown in FIGS. 1 and 2, have been omitted or presumed defective in order to illustrate the antirunaway safety feature. Under these conditions the antirunaway spring 76 will function as a safety device preventing firing of the fuze. When there is a missing or defective dashpot timer assembly 42 or if no fluid 62 or dashpot spring is present there will be no significant resistance force exerted against timing pin 72. Without this resistance force present, the firing pin-slider assembly 46 will move with timer pin 72, and will not depress antirunaway spring front end 82 into the timing pin groove 84, thus permitting antirunaway spring front end 82 to contact the rear end of the cup shaped dashpot housing member 52. Under these conditions antirunaway spring free end 82 impedes any further upward motion of the slider assembly 46 and prevents the firing pin detent ball 96 from lining up with timer housing firing pin detent ball hole 101. The inability of the firing-pin slider assembly 46 to move upwards toward the dashpot timer 42 will prevent further withdrawal of the firing pin point 110 from rotary disc 112 and the unlocking of the biased cup shaped firing pin 92 thus preventing the completion of the fuzing sequence and a possible malfunction due to premature detonation of the grenade to which the fuze is attached.

Figure 4:
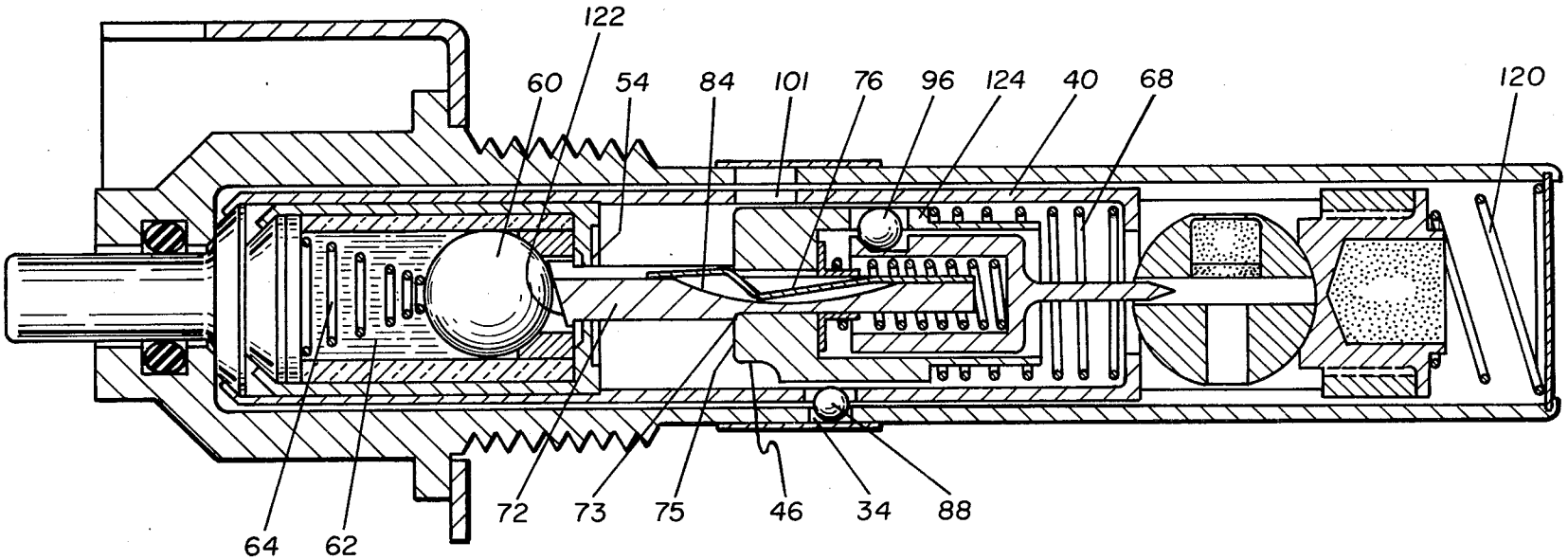
FIG. 4 is a partial cross-sectional view of the fuze shown in FIG. 2 showing how the blocking member is depressed by the biased, detented firing pin-slider assembly so that the fuze can be armed by the dashpot timer assembly.

Referring now to FIG. 4, when there is a properly functioning timer assembly present, arming spring 120 moves the timer housing 40 to a point where the arming ball 88 is aligned with and moves into arming hole 34. The firing pin-slider assembly 46 then forces the leading edge 122 of timing pin 72 to cut sealing disc 54 and contact piston ball 60. The biasing force of timing spring 68, acting against slider assembly shoulder 124 forces the rear end 75 of slider member 70 against timing pin shoulder 73. The timing pin 72 moves toward the dashpot ball piston 60 against the resisting force offerred by piston ball 60 traveling through viscous fluid 62 and the biasing force of dashpot helical spring 64. The dashpot timer resisting forces allows the slider assembly 46 to move a sufficient distance along timer pin 72 to collapse the antirunaway cantilever spring 76 into the timing pin groove 84. The collapsed antirunaway spring 76 allows timing pin 72 to move the required travel and at the required time delay before the firing pin detent ball 96 is aligned with the timer housing firing pin detent ball hole 101.

Figure 5:
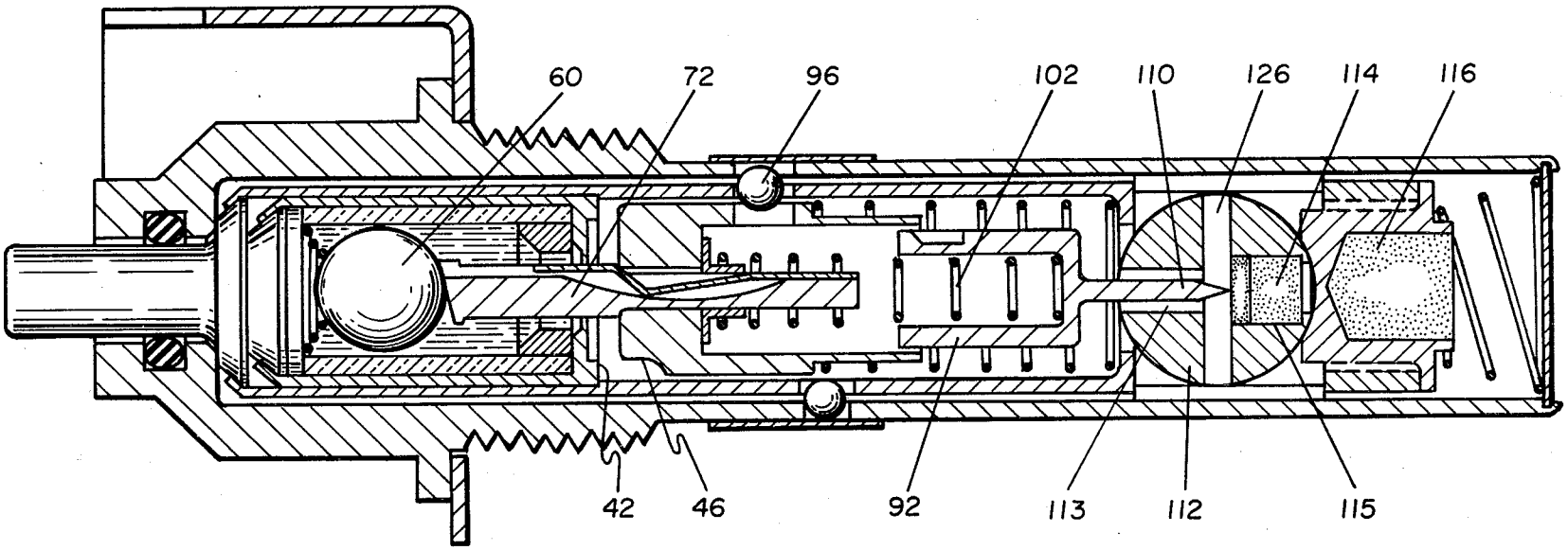
FIG. 5 is a partial cross-sectional view of the grenade fuze just after being armed and the biased firing pin has been released to impact into a rotated in-line detonator.

Referring now to FIG. 5 showing the fuze in its "firing" condition, coincidental with the motion of slider assembly 46 toward dashpot timer assembly 42 is the withdrawal of the firing pin point 110 from rotary disc diametrically disposed safing slot 126 allowing rotary disc 112 to rotate 90° in a clockwise direction to axially align impact sensitive detonator 114 and radially positioned firing bore 113 with firing pin point 110. Detonator 114 is fixedly staked in detonator bore 115 which is axially aligned with firing bore 113 and communicates therewith. When firing pin-slider assembly 46 moves to a point in its travel where the firing pin detent ball 96 is directly opposite to timer housing firing pin detent ball hole 101, the detent ball 96 moves into hole 101 releasing the biased "U" shaped firing pin member 92. The cup shaped firing pin 92 is forcibly moved toward the detonator 114 by the compressed firing spring 102. Firing spring 102 causes firing pin point 110 to impinge and initiate the detonator 114 which in turn causes initiation of booster charge 116 which then causes activation of the main high explosive charge (not shown) in the hand grenade.

The foregoing disclosure and drawings are merely illustrative of the principles of this invention and are not to be interpreted in a limiting sense. We wish it to be understood that we do not desire to be limited to the exact details of construction shown and described for obvious modifications will occur to a person skilled in the art.

Having thus fully described the invention, what is claimed as new and desired to be secured by Letters Patent of the United States is:

1. An antirunaway device for a hand grenade fuze which comprises:

body housing means for protecting said hand grenade fuze against environmental attack and for preventing inadvertent operation of said hand grenade fuze which includes:

a tubular body member having a rear end, a forward end and an annular shoulder peripherally disposed thereon intermediate said rear end and said forward end, said forward end having an axial bore and an "O" ring groove therein said axial bore communicating with said "O" ring groove, said body member having a plurality detent holes transversely disposed therethrough and an axially aligned longitudinal cavity therein;

a bracket member fixedly attached to said annular shoulder;

a safety lever pivotally held by said bracket member;

a safety pin detachably disposed in said lever and said bracket, said safety pin preventing inadvertent activation of said hand grenade fuze;

a closure disc stakedly disposed in said rear end of said tubular body member;

an "O" ring disposed in said "O" ring groove of said forward end of said tubular body member;

foil means peripherally disposed on said body housing means for covering said plurality of detent holes;

a tubularly shaped timer housing, slidably disposed in said axially aligned longitudinal cavity of said tubular body member, said timer housing having a closed staked front end, a partially open rear end, a counterbore positioned in said front end of said timer housing, and a detent arming hole and a firing pin detent ball hole each being transversely disposed therethrough;

a housing cap stakedly positioned in said front end of said timer housing;

dashpot timer means fixedly positioned in said counterbore of said timer housing for providing a time delay for said hand grenade fuze after removal of said safety pin and said safety lever;

antirunaway-firing pin-slider assembly means, biasedly slidably detented in said timer housing, for mechanically detecting absence of said dashpot timer means or malfunctioning thereof and mechanically blocking the initiation of said hand grenade in response to the absence or malfunction of said dashpot timer means and for initiating said hand grenade fuze after said time delay has elapsed;

rotary detonator means tortionally biased and slidably disposed in said rear end of said tubular body member, said rotary detonator means being in abutment with and detented by said antirunaway firing pin-slider assembly means;

booster charge means slidably positioned in said rear end of said tubular body member intermediate said rotary detonator means and said closure disc; and a biased arming spring disposed in said rear end of said tubular body member intermediate said booster charge means and said closure disc.

2. An antirunaway device as recited in claim 1 wherein said antirunaway firing pin-slider assembly means comprises:

a cup shaped detented slider member having a front open end and a rear end, an axial bore located in said front open end, an axial timing pin bore disposed in said rear end; said timing pin bore communicating with said axial bore, a slider member firing pin detent hole transversely disposed through a wall of said slider member and communicating with said axial bore;

an eyelet fixedly disposed in said axial bore of said slider member and axially aligned with said timing pin bore;

a timing pin, axially slidably disposed in said timing pin bore of said slider member, having a front end and a rear end, a timing pin groove longitudinally disposed therein;

a step shaped cantilever spring slidably disposed in said axial timing pin bore of said slider member intermediate said timing pin and said slider member, said cantilever spring being fixedly attached on one end to said rear end of said timing pin, said cantilever spring preventing said hand grenade fuze from being placed in said armed condition when said dashpot timer means is either missing or malfunctioning;

a cup shaped firing pin member, slidably biasedly disposed in said axial bore of said slider member, having a firing pin point thereon which detents said rotary detonator means in an out-of-line position when said hand grenade fuze is in a "safe" condition and releases said rotary detonator means when said hand grenade fuze is in an "armed" condition, and a firing pin arming groove disposed in an exterior wall of said cup shaped firing pin;

a firing pin spring biasedly disposed within said cup shaped firing pin intermediate said eyelet and said cup shaped firing pin member;

a firing pin detent ball operatively positioned in said firing pin arming groove and within said firing pin detent hole of said slider member for holding said firing pin member biasedly attached to said slider member when said hand grenade fuze is in said "safe" condition and for releasing said firing pin member when said slider member firing pin detent hole is in axial alignment with said timer housing firing pin detent ball hole and with one of said plurality of detent holes of said tubular body member;

an arming ball operatively disposed in said firing pin detent arming hole of said timer housing intermediate said slider member and an interior wall of said tubular body member of said body housing means, said arming ball locking said slider member to said timer housing when said hand grenade fuze is in a "safe" condition, said arming ball releasing said slider member from being interlocked with said timer housing when said hand grenade fuze is in said armed condition; and a timing spring disposed intermediate said slider member and said timer housing for urging said antirunaway-firing pin-slider assembly means toward said dashpot timer means and for depressing said step shaped cantilever spring into said timing pin groove when said hand grenade fuze is in an armed condition.

3. An antirunaway device as recited in claim 1 wherein said dashpot timer means comprises:

a cup shaped dashpot housing fixedly disposed in said counterbore of said timer housing; having a sealing disc on one end and including a cap member on the other end;

a tubular piston sleeve disposed in said dashpot housing;

a tubular dashpot stop disposed within said piston sleeve fixedly positioned on said one end of said dashpot housing;

a viscous dashpot fluid disposed in said piston sleeve and said dashpot stop;

a ball piston disposed in said dashpot fluid; and a dashpot helical spring disposed in said piston sleeve intermediate said cap member and said ball piston.

4. An antirunaway device as recited in claim 1 wherein said rotary detonator means comprises:

a tortionally biased detonator disc member having a diametrically disposed safing slot therein and a firing bore radially positioned 90° from said safing slot and communicates therewith, and a radially detonator bore axially aligned with said firing bore and communicating therewith;

an impact sensitive detonator fixedly positioned in said detonator bore, said detonator being rotated in-line with said firing pin point and said booster charge means when said hand grenade fuze is in a "firing" condition, and being rotated in an out-of-line position when said hand grenade fuze is in a "safe" condition.

* * * * *